US007490718B2

(12) United States Patent
Shen

(10) Patent No.: US 7,490,718 B2
(45) Date of Patent: Feb. 17, 2009

(54) COLLAPSIBLE CLOTH TREASURE BOX

(75) Inventor: Wendy Shen, Taipei (TW)

(73) Assignee: Synthesis Enterprise Co., Ltd., Taipei (TW)

( * ) Notice: Subject to any disclaimer, the term of this patent is extended or adjusted under 35 U.S.C. 154(b) by 115 days.

(21) Appl. No.: 11/269,727

(22) Filed: Nov. 9, 2005

(65) Prior Publication Data

US 2007/0102307 A1 May 10, 2007

(51) Int. Cl.
*A45C 11/16* (2006.01)
*B65D 1/34* (2006.01)
*B65D 25/16* (2006.01)
*B65D 81/02* (2006.01)

(52) U.S. Cl. ..... 206/6.1; 206/566; 206/583; 220/495.01

(58) Field of Classification Search ..... 206/6.1, 206/566, 583, 591–594; 220/495.01
See application file for complete search history.

(56) References Cited

U.S. PATENT DOCUMENTS 1,421,628 A * 7/1922 Watkins ..... 220/495.01
1,695,802 A * 12/1928 Dreux ..... 206/6.1
1,937,868 A * 12/1933 Brooks ..... 206/566
2,700,460 A * 1/1955 Hoover ..... 206/583
2,700,518 A * 1/1955 Ryno et al. ..... 206/583
2,771,184 A * 11/1956 Ryno et al. ..... 206/583
2,785,795 A * 3/1957 Ryno et al. ..... 220/495.01
4,491,225 A * 1/1985 Baillod ..... 206/583
5,316,147 A * 5/1994 Weber-Unger ..... 206/592
5,603,558 A * 2/1997 Zimmer ..... 206/566
6,247,584 B1 * 6/2001 Au ..... 206/6.1

* cited by examiner

*Primary Examiner*—Bryon P Gehman
(74) *Attorney, Agent, or Firm*—Troxell Law Office, PLLC

(57) ABSTRACT

A collapsible treasure box is disclosed and includes an enclosure including an enclosed inner layer and an enclosed outer layer formed of soft cloth, the outer layer being in covering relationship with the inner layer wherein top edges of the inner and the outer layers are stitched together, an enclosed upper frame member concealed by passing upper portions of the inner and outer layers through a bore of the frame member to wrap around a bottom of the frame member, and a lower container member having an open top, the container being enclosed by wrapping a lower portion of the outer layer therearound by stitching bottoms of the inner and the outer layers together. Turning a top of the treasure box until a top opening thereof is closed and folding inside of the treasure box toward outside thereof continuously will shape the treasure box as a bun.

2 Claims, 7 Drawing Sheets

COLLAPSIBLE CLOTH TREASURE BOX

BACKGROUND OF THE INVENTION

1. Field of Invention

The present invention relates to treasure boxes and more particularly to a collapsible treasure box with improved characteristics (e.g., aesthetic appearance, etc.)

2. Related Art

Treasure boxes are well known. Treasure boxes are typically owned by women. A conventional treasure box is shown in FIG. 1 and comprises a parallelepiped container A formed of cardboard having a cover B at one side, the cover B having a magnetic member C in the form of a button adapted to releasably secure to a corresponding magnetic member C on a top center of the container A.

Another conventional treasure box is shown in FIG. 2 and comprises a cylindrical container B1 formed of metal having a top cover A1, a hinge D1 interconnected the cover A1 and a circular top edge of the container B1, and a fastening member (e.g., zipper (as shown), magnetic member, or the like) C1 formed around the top edge of the container B1, the fastening member C1 being adapted to releasably secure to a corresponding fastener member formed on a circular bottom edge of the cover A1.

A further conventional treasure box is shown in FIG. 3 and it is constructed similar to the treasure box shown in FIG. 2 with an exception as detailed below. A resilient metal plate E1 is extended toward both sides of the hinge D1 into the cover A1 and the container B1 respectively. In use, a user has to exert a force to overcome a stored elastic force of the plate E1 in order to open or close the box by holding and pivoting the cover A1 about the hinge D1 clockwise or counterclockwise.

However, the prior treasure boxes are typically trouble-prone (e.g., magnetic members being subject to deformation, resilient member being subject to elastic fatigue, or the like) and thus unreliable in use. Also, it is somewhat visually unattractive. Thus, a need for improvement exists.

SUMMARY OF THE INVENTION

It is therefore an object of the present invention to provide a collapsible treasure box comprising an enclosure including an enclosed inner layer and an enclosed outer layer formed of soft cloth, the outer layer being in covering relationship with the inner layer wherein top edges of the inner and the outer layers are stitched together; an enclosed upper frame member concealed by passing upper portions of the inner and outer layers through a bore of the frame member to wrap around a bottom of the frame member; and a lower container member having an open top, the container being enclosed by wrapping a lower portion of the outer layer therearound by stitching bottoms of the inner and the outer layers together; whereby turning a top of the treasure box until a top opening thereof is closed and folding inside of the treasure box toward outside thereof continuously will shape the treasure box as a bun.

In one aspect of the present invention, the inner layer is formed of strong fabric.

The above and other objects, features and advantages of the present invention will become apparent from the following detailed description taken with the accompanying drawings.

DETAILED DESCRIPTION OF THE INVENTION

Figure 1:
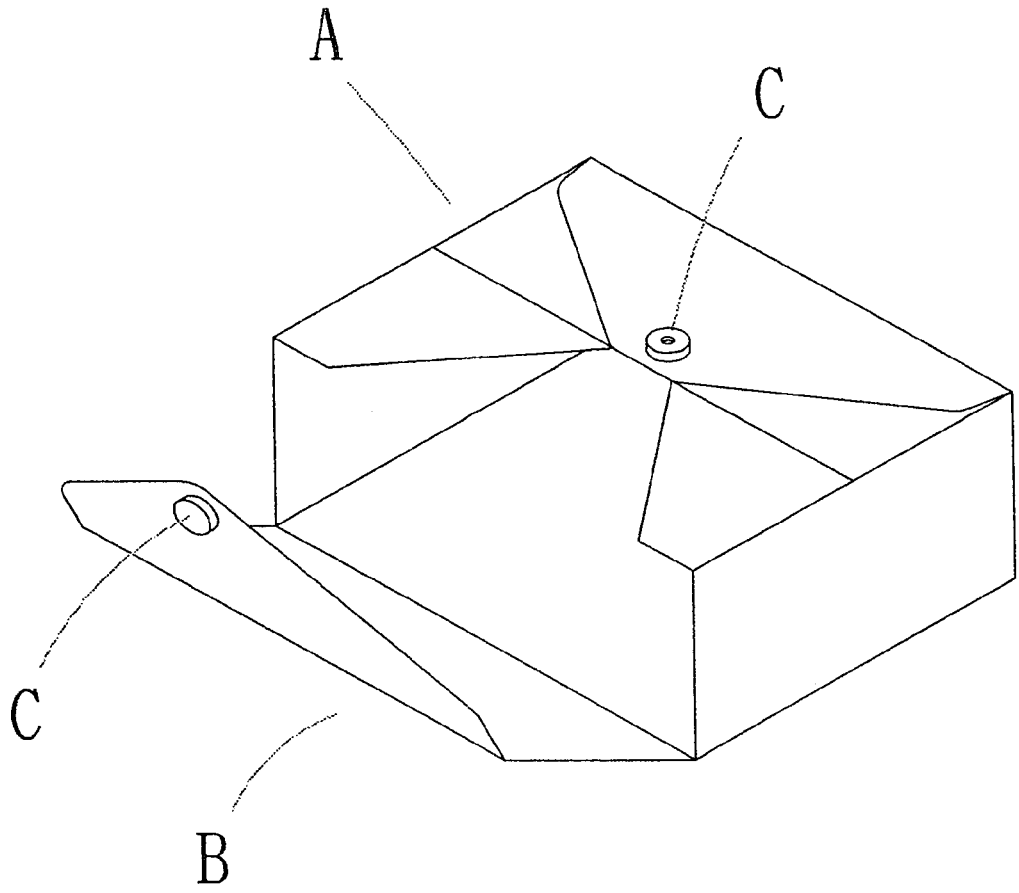
FIG. 1 PRIOR ART
FIG. 1 is a perspective view of a conventional treasure box in its open state.
Figure 2:
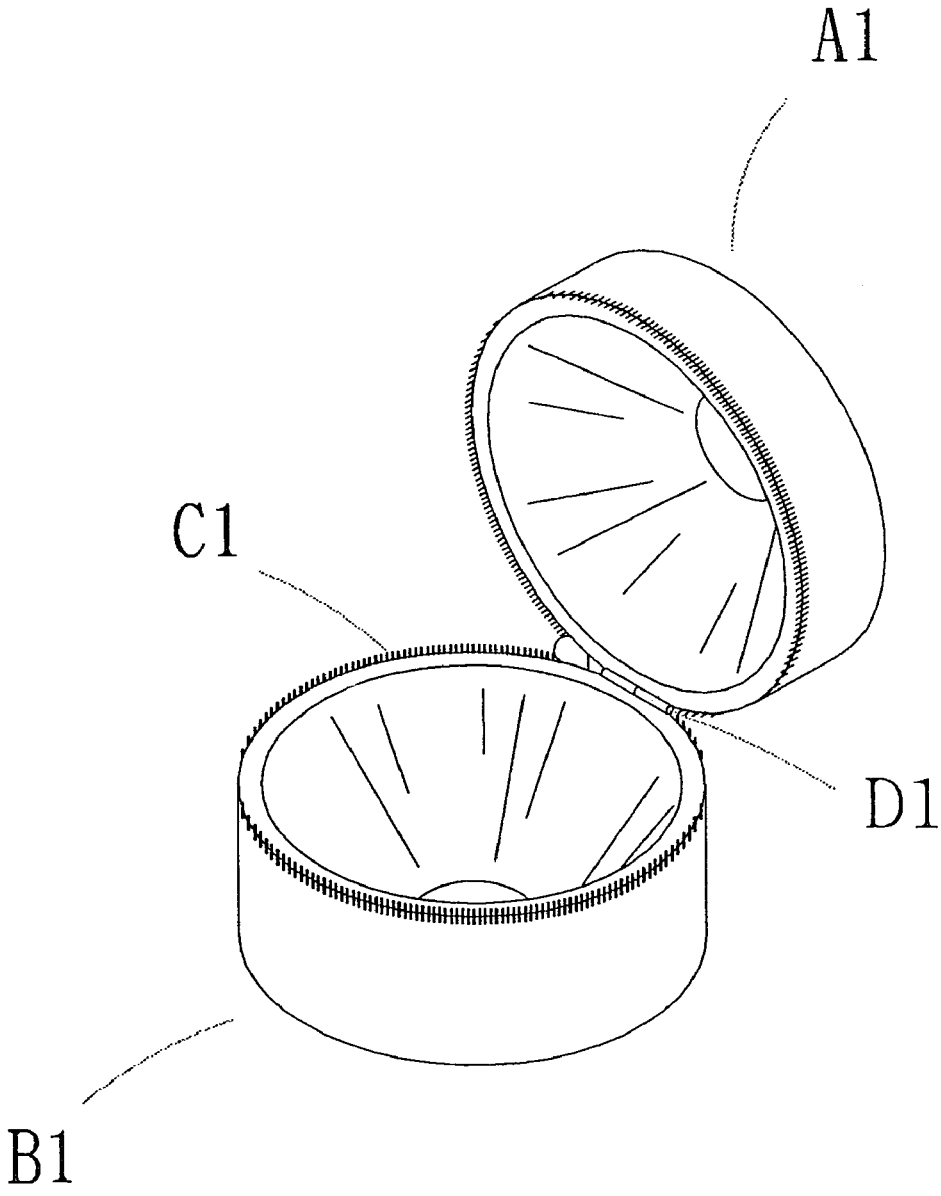
FIG. 2 PRIOR ART
FIG. 2 is a perspective view of another conventional treasure box in its open state.
Figure 3:
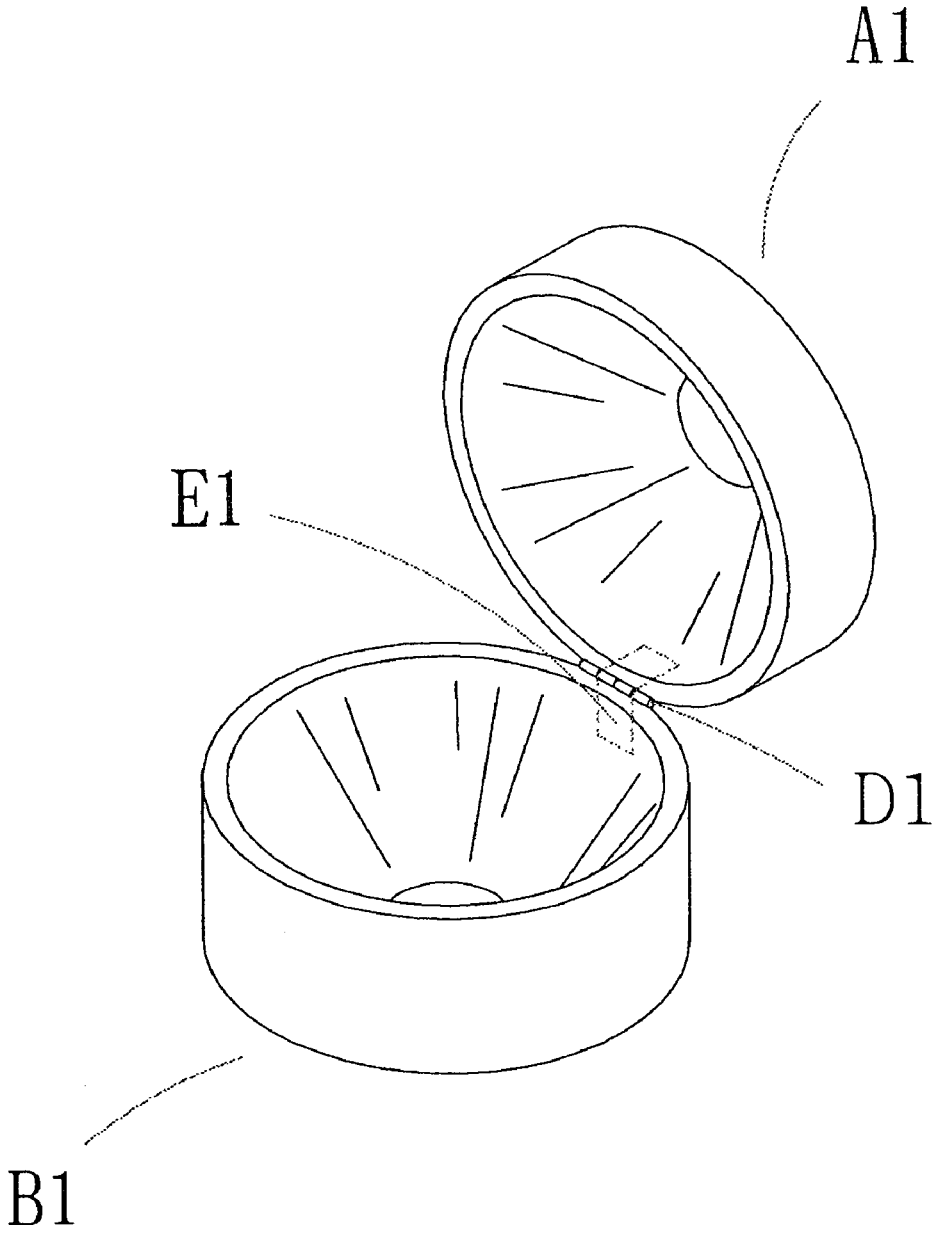
FIG. 3 PRIOR ART
FIG. 3 is a perspective view of a further conventional treasure box in its open state.
Figure 4:
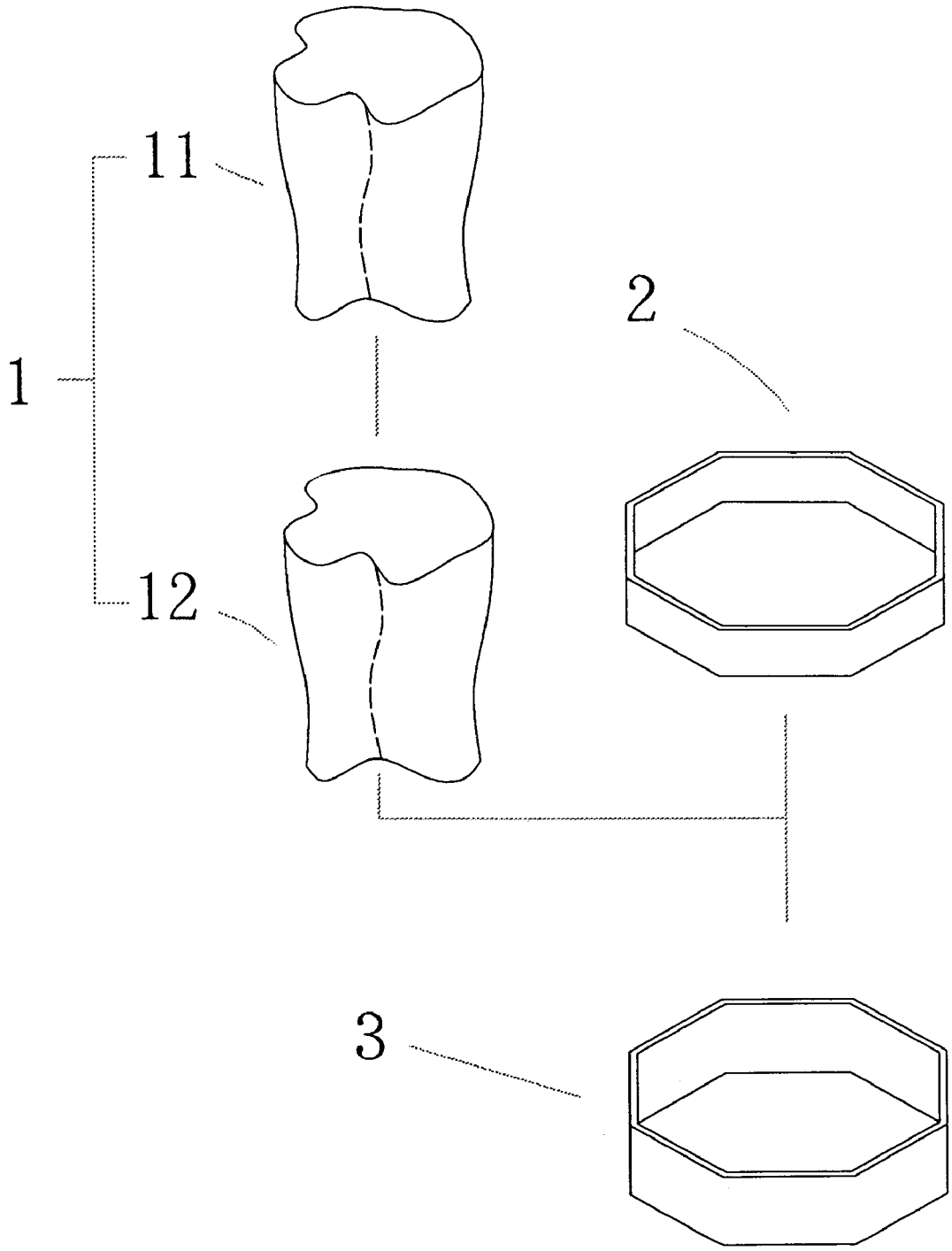
FIG. 4 is an exploded view of a preferred embodiment of treasure box according to the invention.
Figure 5:
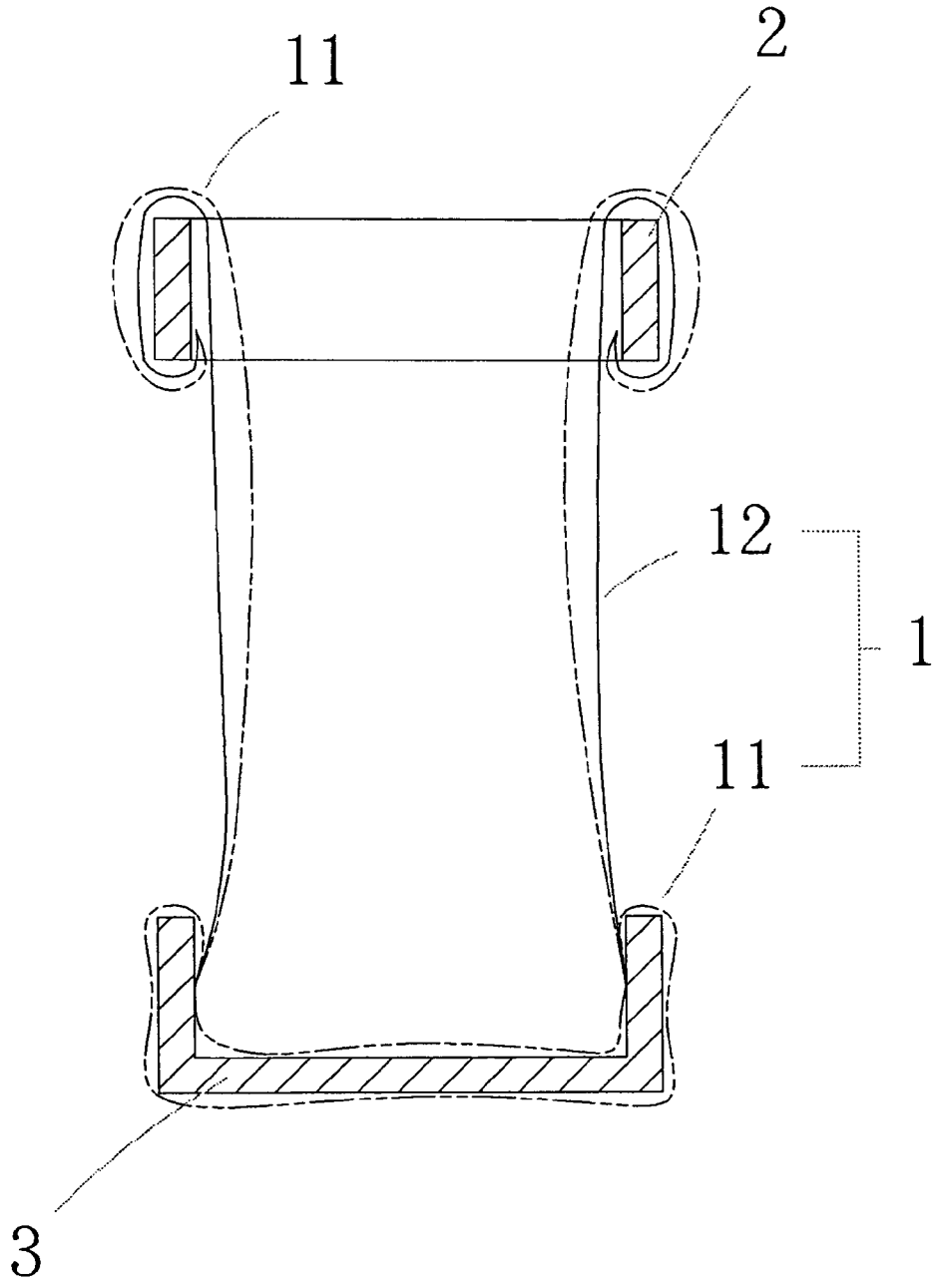
FIG. 5 is a longitudinal sectional view of the partially assembled treasure box shown in FIG. 4.
Figure 6:
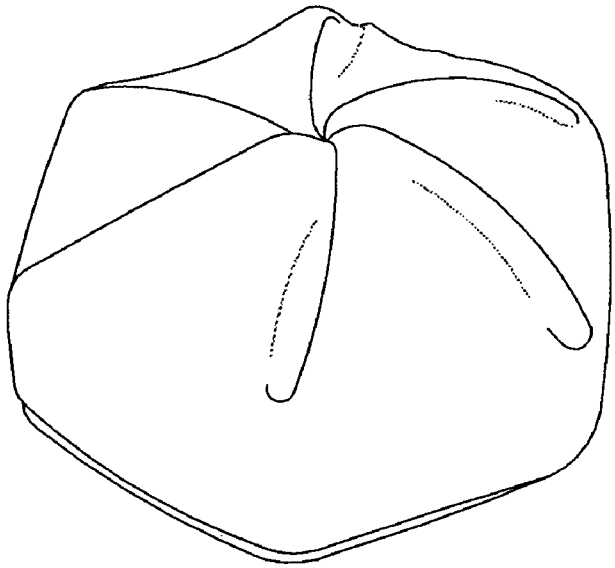
FIG. 6 is a perspective view of the fully assembled treasure box shown in FIG. 4.

Referring to FIGS. 4 to 7, a treasure box in accordance with a preferred embodiment of the invention comprises an enclosed upper frame member 2, a lower container member 3 with an open top, and an enclosure 1 including an enclosed inner layer 12 formed of strong fabric for enhancing a structural strength of the treasure box, and an enclosed outer layer 11 formed of soft cloth.

Figure 7:
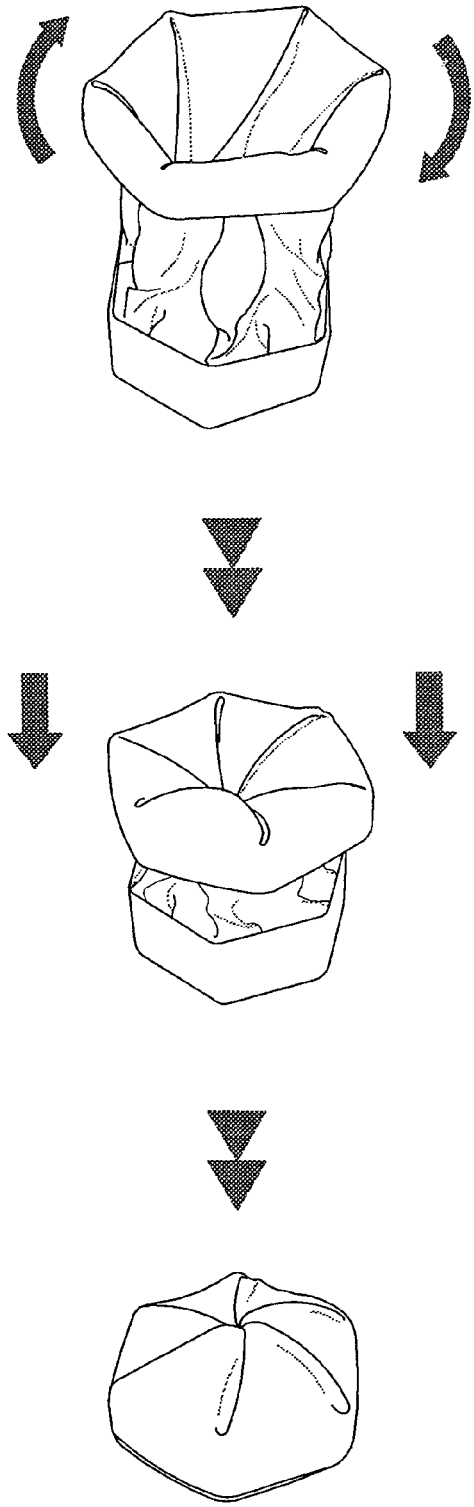
FIG. 7 is a perspective view illustrating two steps of forming the treasure box according to the invention.

In assembly, put the outer layer 11 on the inner layer 12. That is, the outer layer 11 is in covering relationship with the inner layer 12. Next, stitch a top edge of the inner layer 12 to that of the outer layer 11. Next, pass top edges of the inner and outer layers 12 and 11 through a bore of the frame member 2 to wrap around a bottom of the frame member 2 with the frame member 2 being completely concealed. Next, enclose the container member 3 by wrapping a lower portion of the outer layer 11 therearound. Next, stitch a bottom of the inner layer 12 with that of the outer layer 11 for completely concealing the container member 3. Finally, as shown in FIG. 7, after placing jewels or the like into the fully extended treasure box (see FIG. 5), a person may turn a top of treasure box until a top opening thereof is closed. Next, fold inside of the treasure box toward outside thereof until a bun-shaped treasure box is formed (see bottom of FIG. 7 and FIG. 6). As an end, the stored jewels or the like are prevented from dropping out of the treasure box while carrying.

While the invention herein disclosed has been described by means of specific embodiments, numerous modifications and variations could be made thereto by those skilled in the art without departing from the scope and spirit of the invention set forth in the claims.

What is claimed is:

1. A collapsible treasure box comprising:

an enclosure including an enclosed inner layer and an enclosed outer layer formed of soft cloth, the outer layer being in covering relationship with the inner layer wherein top edges of the inner and outer layers are stitched together;

an enclosed upper frame member concealed by passing upper portions of the inner and outer layers through a bore of the frame member to wrap around a bottom of the frame member; and a lower container member having an upper opening, the lower container member being enclosed by wrapping a lower portion of the outer layer therearound by stitching bottoms of the inner and outer layers together, wherein twisting the enclosed upper frame member of the treasure box relative to the lower container member until an upper opening of the enclosed upper frame member is closed by folding the upper portion of the inner and outer layers and pressing the enclosed upper frame member towards the lower container member will shape the treasure box in the shape of a bun.

2. The treasure box of claim 1, wherein the inner layer is formed of strong fabric.

* * * * *